US012203045B2

(12) United States Patent
Dong et al.

(10) Patent No.: US 12,203,045 B2
(45) Date of Patent: Jan. 21, 2025

(54) COMPOSITIONS COMPRISING ALKYLATED DIPHENYLAMINES WITH IMPROVED PROPERTIES

(71) Applicant: SONGWON INDUSTRIAL CO., LTD., Ulsan (KR)

(72) Inventors: Jun Dong, Friendswood, TX (US); Jeonkyu Lee, Ulsan (KR); Gerard Mulqueen, Frauenfeld (CH)

(73) Assignee: SONGWON INDUSTRIAL CO., LTD., Ulsan (KR)

( * ) Notice: Subject to any disclaimer, the term of this patent is extended or adjusted under 35 U.S.C. 154(b) by 0 days.

(21) Appl. No.: 18/037,216

(22) PCT Filed: Nov. 16, 2021

(86) PCT No.: PCT/KR2021/016769
§ 371 (c)(1),
(2) Date: May 16, 2023

(87) PCT Pub. No.: WO2022/108298
PCT Pub. Date: May 27, 2022

(65) Prior Publication Data

US 2023/0416631 A1 Dec. 28, 2023

Related U.S. Application Data

(60) Provisional application No. 63/114,561, filed on Nov. 17, 2020.

(51) Int. Cl.
*C10M 133/12* (2006.01)
*C10N 20/00* (2006.01)
(Continued)

(52) U.S. Cl.
CPC .... *C10M 133/12* (2013.01); *C10M 2215/064* (2013.01); *C10N 2020/017* (2020.05);
(Continued)

(58) Field of Classification Search
CPC ..... C10M 133/12; C10M 2215/064; C10M 2203/1025; C10M 2215/067;
(Continued)

(56) References Cited

U.S. PATENT DOCUMENTS 3,655,559 A 4/1972 Holt
4,770,802 A 9/1988 Ishida et al.
(Continued)

FOREIGN PATENT DOCUMENTS

GB 1046353 A 10/1966
JP 62012786 B 3/1987
(Continued)

OTHER PUBLICATIONS

Rudnick et al. "Lubricant Additives, Chemistry and Application" pp. 13-16; 413-415 (2003).
(Continued)

*Primary Examiner* — Prem C Singh
*Assistant Examiner* — Francis C Campanell
(74) *Attorney, Agent, or Firm* — Meunier Carlin & Curfman LLC

(57) ABSTRACT

The present invention relates to a composition comprising alkylated diphenylamines of the structural formulas (I), (II), (III), and (IV), to industrial products such as additive blends, engine oils, and polymer compositions comprising the mixture of alkylated diphenylamines, and to the use of the mixture as an additive such in industrial products such as additive blends, engine oils and polymer compositions: wherein R is a branched $C_4$-$C_{16}$-alkyl group, and wherein the total amount of tetra-alkylated diphenylamines of the structural formula (IV) is in the range from 0.20 to 3.5 wt. %, based on the total weight of alkylated diphenylamines of the structural formula (I), (II), (III), and (IV) in the composition.

(I)

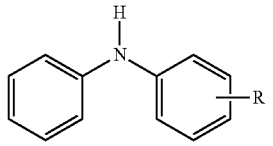

(II)

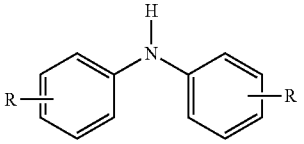

(III)

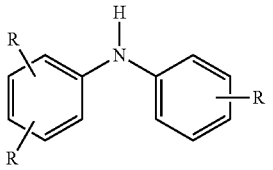

(IV)

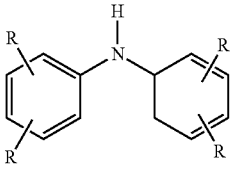

14 Claims, No Drawings

(51) Int. Cl.

| | |
|---|---|
| *C10N 20/02* | (2006.01) |
| *C10N 30/00* | (2006.01) |
| *C10N 30/10* | (2006.01) |
| *C10N 30/12* | (2006.01) |

(52) U.S. Cl.
CPC ..... *C10N 2020/02* (2013.01); *C10N 2030/10* (2013.01); *C10N 2030/12* (2013.01); *C10N 2030/52* (2020.05)

(58) Field of Classification Search
CPC ..... C10N 2020/02; C10N 2030/10; C10N 2030/12; C10N 2030/52; C10N 2040/25; C09K 15/18
USPC ..... 508/563
See application file for complete search history.

(56) References Cited

U.S. PATENT DOCUMENTS

| | | | |
|---|---|---|---|
| 6,204,412 | B1 | 3/2001 | Lai |
| 6,315,925 | B1 | 11/2001 | Aebli et al. |
| 6,355,839 | B1 | 3/2002 | Onopchenko |
| 6,419,797 | B1 | 7/2002 | Scherf et al. |
| 7,531,487 | B2 | 5/2009 | Al-Akhdar et al. |
| 7,847,030 | B2 | 12/2010 | Patil et al. |
| 7,928,045 | B2 | 4/2011 | Dong et al. |
| 8,030,259 | B2 | 10/2011 | Aebli et al. |
| 9,782,183 | B1 | 10/2017 | Rich |
| 10,487,043 | B2 | 11/2019 | Rowland |
| 2004/0038835 | A1 | 2/2004 | Chasen et al. |
| 2005/0019245 | A1 | 1/2005 | Koulikov et al. |
| 2010/0173811 | A1 | 7/2010 | Arrowsmith et al. |
| 2016/0017252 | A1* | 1/2016 | Rowland ..... C10M 133/12 508/563 |
| 2016/0032213 | A1* | 2/2016 | Green ..... C10M 171/02 508/591 |
| 2020/0165188 | A1 | 5/2020 | Rowland |

FOREIGN PATENT DOCUMENTS

| | | | |
|---|---|---|---|
| JP | S62-032184 | B2 | 7/1987 |
| JP | 63295531 | A | 12/1988 |
| JP | 180851 | U | 5/1989 |
| JP | 0135897 | B2 | 7/1989 |
| JP | 021537 | B2 | 1/1990 |
| JP | 0238989 | A | 2/1990 |
| JP | 048989 | A | 1/1992 |
| JP | 06048989 | A | 2/1994 |
| JP | 107596 | A | 1/1998 |
| WO | 9507963 | A1 | 3/1995 |

OTHER PUBLICATIONS

International Search Report and Written Opinion in Application No. PCT/KR2021/016769, mailed Jan. 20, 2022, 26 pages.

Sklenar et al. "Discontinuous alkylation of diphenylamine with nonene for maximum catalyst utilization," Chem. Pap. 71:1453-1461 (2017).

* cited by examiner

COMPOSITIONS COMPRISING ALKYLATED DIPHENYLAMINES WITH IMPROVED PROPERTIES

TECHNICAL FIELD

The present invention relates to a composition comprising alkylated diphenylamines. The invention also relates to industrial products comprising this composition and to the use of this composition as an additive in industrial products.

BACKGROUND ART

Lubricants, such as those used in a variety of machinery, are susceptible to oxidative deterioration during storage, transportation, and usage, particularly when such lubricants are exposed to high temperatures and iron catalytic environments, which greatly promote their oxidation. This oxidation, if not controlled, contributes to the formation of corrosive acidic products, sludge, varnishes, resins, and other oil-insoluble products, and may lead to a loss of designated physical and tribological properties of the lubricants. It is therefore a common practice to include an antioxidant in lubricants to prevent, at least to some extent, oxidation, so as to extend their useful life. Lubricant compositions containing various diarylamines or phenolic compounds as antioxidants are widely known in the art.

WO 2007/100726 A2 discloses a lubricant composition comprising at least one lubricating oil selected from the group consisting of natural and synthetic lubricating base oils, at least one first antioxidant which can be an alkylated diphenylamine and at least one sulphur containing alkylated phenol as second antioxidant, wherein a synergistic effect has been observed with respect to oxidative stability when supplementing a lubricant with the first and the second antioxidant.

However, the disadvantage of that approach can be seen in the fact that in order to improve the oxidative stability of the engine oil a new class of additives (i. e. sulfur containing alkylated phenols) has to be added to the engine oil which again not only increases the complexity of the fully finished engine lubricants, but also the costs for their production.

Moreover, engine oil specifications are becoming more stringent in the way of performance requirements, and new formulations are under development to meet these new specifications. Many of the additives that are contained in engine oils are corrosive to lead. It is difficult for formulators to meet the present engine oil specifications by employing certain beneficial additives while also meeting the specification for lead corrosion. For example, certain components of formulated engine oils that cause lead corrosion include certain detergents, antiwear additives, friction modifiers and antioxidants. Many such desired additive chemistries are disqualified from use due to causing engine oil formulations to not meet industry specifications for limits on lead corrosion.

WO 2004/015043 A1 discloses an engine oil which comprises certain 1,2,4-triazole metal deactivators that are especially non-aggressive towards lead. The disadvantage of this approach, however, also has to be seen in the fact that a further complex chemical additive has to be added to the engine oil which usually already comprises a complex mixture of additives such as antioxidants, antiwear additives, dispersants, detergents, antifoam additives, viscosity index improvers, copper passivators, rust inhibitors, pour-point depressants, demulsifiers and friction modifiers. This approach thus not only increases the complexity of the fully finished engine lubricants, but also the costs for their production.

DISCLOSURE OF INVENTION

Technical Problem

It is therefore an object of the present invention to overcome the disadvantages of the prior art associated with compositions that are used to improve the properties of industrial products such as engine oils, particularly with respect to their oxidative stability, but preferably also with respect to their resistance towards the corrosion of lead.

In particular, it is an object of the present invention to provide a composition that, when being added as a separate additive or as a component in a so called "additive package" into a base oil for the formation of a fully finished engine oil or that, improves the properties of engine oils, particularly with respect to the oxidative stability and preferably also with respect to the resistance towards the corrosion of lead.

More preferably, it was an object of the present invention to provide a composition that, when being added as a separate additive or as a component in an additive package into a base oil for the formation of a fully finished engine oil or that, when already being present in the form of a fully finished engine oil, leads to an advantageous combination of the properties of a high oxidative stability and a good resistance towards the corrosion of lead.

Solution to Problem

A contribution to at least partly solving at least one, preferably more than one, of the above objects is made by the independent claims. The dependent claims provide preferred embodiments which contribute to at least partly solving at least one of the objects.

A contribution to solving at least one of the objects according to the present invention is made by an embodiment 1 of a composition comprising alkylated diphenylamines of the structural formulas (I), (II), (III), and (IV):

(I)

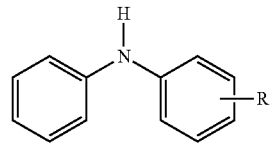

(II)

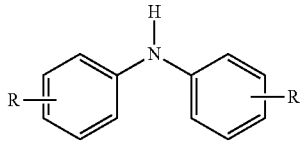

(III)

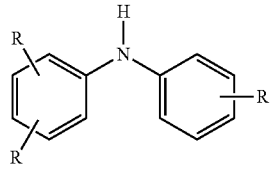

-continued (IV)

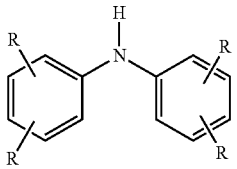

wherein R is a branched $C_4$-$C_{16}$-alkyl group, and wherein the total amount of tetra-alkylated diphenylamines of the structural formula (IV) is in the range from 0.20 to 3.5 wt. %, more preferably in the range from 0.21 to 3.3 wt. %, and even more preferably in the range from 0.22 to 3.1 wt. %, in each case based on the total weight of alkylated diphenylamines of the structural formulas (I), (II), (III) and (IV) in the composition.

The line connected to residue R in the structural formulas (I), (II), (III), and (IV) indicates that this residue R can be connected to any of the carbon atoms of the benzene ring (i. e. at the ortho, meta or para position). An alkylated diphenylamine of the structural formula (I) thus represents a mono-substituted diphenylamine derivative, an alkylated diphenylamine of the structural formula (II) a di-substituted diphenylamine derivative, an alkylated diphenylamine of the structural formula (III) a tri-substituted diphenylamine derivative, and an alkylated diphenylamine of the structural formula (IV) a tetra-substituted diphenylamine derivative.

Additives for lubricants comprising a mixture of alkylated diphenylamines of the structural formulas (I), (II), and (III) are known from the prior art. They are used as an antioxidant in order to improve the oxidative stability of lubricants such as engine oils. However, it has now surprisingly been discovered that by ensuring that these compositions comprise a well-defined amount of the tetra-alkylated diphenylamine having the structural formula (IV), an improved performance of an engine oil that comprises such an additive can be achieved with respect to the oxidative stability. It is particularly surprising that by ensuring that these compositions comprise a well-defined amount of the tetra-alkylated diphenylamine the resistance towards the corrosion of lead can also be improved.

The composition according to the present invention can be prepared by providing a mixture of alkylated diphenylamines having the structural formulas (I), (II), and (III), and by supplementing this mixture with the tetra-alkylated diphenylamine having the structural formula (IV) in the desired amount.

A process for the production of alkylated diphenylamines having the structural formulas (I), (II), and (III) is, for example, disclosed in U.S. Pat. No. 6,315,925 B1. Here, diphenylamine is reacted with alkenes on acid clays as catalysts. For the preparation of the preferred nonyl-alkylated diphenylamines, in which R represents a branched residue having the formula —$C_9H_{19}$, diphenylamine can be alkylated with an excess of nonene or a mixture of isomeric nonenes in the presence of from 2.0 to 25.0% by weight, based on diphenylamine, of an acid clay and in the absence of inorganic or organic acids in the reaction mixture as shown, for example, in Example 1 of U.S. Pat. No. 6,315,925 B1.

Alkylated diphenylamines having the structural formulas (IV), such as tetranonyl diphenylamine, can be produced by reacting diphenylamine with an excess of alkenes (such as nonene in the case of tetranonyl diphenylamine) for a reaction time of 4 weeks under reaction temperatures between 140 and 155° C. under atmospheric pressure. From the thus obtained reaction mixture comprising the mono-, di-, tri- and tetra-substituted diphenylamines the tetra-substituted diphenylamines having the structural formulas (IV) can, for example, be further enriched by distillation. With the help of the thus obtained fraction comprising an enriched content of the alkylated diphenylamines having the structural formulas (IV) the content of this isomer in a given mixture of alkylated diphenyl amines having the structural formulas (I), (II), and (III) can be adjusted by adding an appropriate amount of this fraction to the given mixture.

In an embodiment 2 of the composition according to the present invention the composition is designed according to its embodiment 1, wherein the total amount of monoalkylated diphenylamines of the structural formula (I) is in the range from 10 to 35 wt. %, more preferable in the range from 13 to 30 wt. %, and even more preferably in the range from 16 to 25 wt. %, in each case based on the total weight of alkylated diphenylamines of the structural formula (I), (II), (III) and (IV) in the composition.

In an embodiment 3 of the composition according to the present invention the composition is designed according to its embodiment 1 or 2, wherein the total amount of dialkylated diphenylamines of the structural formula (II) is in the range from 60 to 85 wt. %, more preferable in the range from 65 to 82 wt. %, and even more preferably in the range from 70 to 79 wt. %, in each case based on the total weight of alkylated diphenylamines of the structural formula (I), (II), (III), and (IV) in the composition.

In an embodiment 4 of the composition according to the present invention the composition is designed according to anyone of its embodiments 1 to 3, wherein the total amount of trialkylated diphenylamines of the structural formula (III) is in the range from 1 to 10 wt. %, more preferable in the range from 2 to 8 wt. %, and even more preferably in the range from 3 to 6 wt. %, in each case based on the total weight of alkylated diphenylamines of the structural formula (I), (II), (III), and (IV) in the composition.

In an embodiment 5 of the composition according to the present invention the composition is designed according to anyone of its embodiments 1 to 4, wherein the composition comprises less than 1 wt. %, preferably less than 0.5 wt. %, and more preferably less than 0.1 wt. % non-alkylated diphenylamine having the structural formula $C_{12}H_{11}N$, in each case based on the total weight of alkylated diphenylamines of the structural formula (I), (II), (III), and (IV) the composition.

In an embodiment 6 of the composition according to the present invention the composition is designed according to anyone of its embodiments 1 to 5, wherein residue R is an alkyl group from 1 to 20 carbon atoms, which may be branched or straight-chain, e.g., methyl, ethyl, propyl, butyl, pentyl, hexyl, heptyl, octyl, nonyl, decyl, undecyl, dodecyl, isomers of the foregoing, e.g., t-butyl, 2-ethylhexyl, and the like, and mixtures of the foregoing.

In an embodiment 7 of the composition according to the present invention the composition is designed according to its embodiment 6, wherein residue R is a branched alkyl group having the formula —$C_9H_{19}$.

In an embodiment 8 of the composition according to the present invention the composition is designed according to its embodiment 7, wherein the composition, in addition to alkylated diphenylamines of the structural formula (I), (II), (III), and (IV), comprises less than 1 wt. %, preferably less than 0.5 wt. %, and even more preferably less than 0.1 wt. % of alkylated diphenylamines which carry at least one alkyl group R' that is not a branched alkyl group having the formula —$C_9H_{19}$, in each case based on the total weight of alkylated diphenylamines of the structural formula (I), (II), (III), and (IV) in the composition.

In an embodiment 9 of the composition according to the present invention the composition is designed according to anyone of its embodiments 1 to 8, wherein at least one of the following conditions (α1) to (α7), preferably all the following conditions (α1) to (α6) is/are fulfilled:

(α1) the composition has a kinematic viscosity (determined at a temperature of 40° C. according to ASTM D 445) in the range from 100 to 1000 cSt, more preferably in the range from 200 to 900 cSt, and more preferably in the range from 450 to 650 cSt;

(α2) the composition has a Gardner colour (determined according to ASTM D 1544) of less than 15 Gardner, preferably less than 10 Gardner, and more preferably of less than 5 Gardner;

(α3) the composition has water content (determined according to ASTM E 203) of less than 0.1 wt. %, preferably less than 0.05 wt. %, and more preferably less than 0.01 wt. %;

(α4) the composition has a nitrogen content (determined according to ASTM D 2896) in the range from 3.2 to 3.8%, preferably in the range from 3.3 to 3.7%, and more preferably in the range from 3.4 to 3.9 wt. %;

(α5) the composition has a specific gravity (determined at a temperature of 25° C. according to ASTM D 1298) in the range from 0.930 to 0.980, preferably in the range from 0.935 to 0.975, and more preferably in the range from 0.940 to 0.970; and (α6) the composition has a total base number (TBN) (determined according to ASTM D 2896) in the range from 125 to 160 mg KOH/g, preferably in the range from 130 to 150 mg KOH/g, and more preferably in the range from 135 to 145 mg KOH/g.

In an embodiment 10 of the composition according to the present invention, the composition is designed according to anyone of its embodiments 1 to 9, wherein the total amount of alkylated diphenylamines of the structural formula (I), (II), (III), and (IV), preferably the total amount of alkylated diphenylamines of the structural formula (I), (II), (III), and (IV) in which R is a branched residue having the formula —$C_9H_{19}$, is at least 98 wt. %, more preferably at least 98.5 wt. % and even more preferably at least 99 wt. %, in each case based on the total weight of the composition.

In an embodiment 11 of the composition according to the present invention the composition is designed according to anyone of its embodiments 1 to 10, wherein the composition is a lubricant or a lubricating composition.

In an embodiment 12 of the composition according to the present invention, the composition is designed according to its embodiment 11, wherein the composition is an additive blend. An "additive blend" (also called "additive master batch" or "additive package") is a blend for treatment of industrial and automotive lubricants, which comprises a combination of different additives such as antioxidants, antiwear additives, dispersants, ashless (metal free) polymeric materials, detergents, antifoam additives, viscosity index improvers, copper passivators, rust inhibitors, pour point depressants, demulsifiers and friction modifiers. The mixture of alkylated diphenylamines of the structural formula (I), (II), (III), and (IV) according to the present invention may thus by a part of such an additive package.

In an embodiment 13 of the composition according to the present invention the composition is designed according to its embodiment 12, wherein the additive blend comprises additives that are aggressive towards lead, preferably additives selected from the group consisting of sulfur-containing antioxidants, sulfur-containing antiwear additives, sulfur-containing copper passivators or vegetable oil-derived friction modifiers.

In an embodiment 14 of the composition according to the present invention the composition is designed according to its embodiment 12 or 13, wherein the total amount of alkylated diphenylamines of the structural formula (I), (II), (III), and (IV), preferably the total amount of alkylated diphenylamines of the structural formula (I), (II), (III), and (IV) in which R is a branched residue having the formula —$C_9H_{19}$, is in the range from 0.01 to 30 wt. %, preferably in the range from 0.1 to 20 wt. %, and even more preferably in the range from 0.5 to 10 wt. %, in each case based on the total weight of the additive blend.

In an embodiment 15 of the composition according to the present invention the composition is designed according to its embodiment 11, wherein composition is an engine oil.

In an embodiment 16 of the composition according to the present invention the composition is designed according to its embodiment 15, wherein the engine oil comprises at least one base oil and the mixture of alkylated diphenylamines of the structural formula (I), (II), (III), and (IV), preferably the mixture of alkylated diphenylamines of the structural formula (I), (II), (III), and (IV) in which R is a branched residue having the formula —$C_9H_{19}$, as defined in embodiments 1 to 7, preferably in the form of an additive blend as defined in embodiments 12 to 14.

In an embodiment 17 of the composition according to the present invention, the composition is designed according to its embodiment 16, wherein the total amount of alkylated diphenylamines of the structural formula (I), (II), (III), and (IV) in which R is a branched $C_4$-$C_{16}$-alkyl group, preferably the total amount of alkylated diphenylamines of the structural formula (I), (II), (III), and (IV) in which R is a branched residue having the formula —$C_9H_{19}$, is in the range from 0.01 to 5 wt. %, preferably in the range from 0.05 to 2.5 wt. %, and even more preferably in the range from 0.1 to 1.5 wt. %, in each case based on the total weight of the engine oil.

In an embodiment 18 of the composition according to the present invention, the composition is designed according to its embodiment 11, wherein the composition is a polymer composition comprising a polymer, preferably a thermoplastic polymer, preferably a polyurethane.

In an embodiment 19 of the composition according to the present invention, the composition is designed according to its embodiment 18, wherein the total amount of alkylated diphenylamines of the structural formula (I), (II), (III), and (IV), preferably the total amount of alkylated diphenylamines of the structural formula (I), (II), (III), and (IV) in which R is a branched residue having the formula —$C_9H_{19}$, is in the range from 0.01 to 1.0 wt. %, preferably in the range from 0.05 to 0.75 wt. %, and even more preferably in the range from 0.1 to 0.5 wt. %, in each case based on the total weight of the polymer composition.

In an embodiment 20 of the composition according to the present invention, the composition is designed according to its embodiment 18 or 19, wherein the thermoplastic polymer is selected from the group consisting of low density polyethylene (LDPE), linear low density polyethylene (LLDPE), medium density polyethylene (MDPE), high density polyethylene (HDPE), homopolymers derived from mono- and diethylenically unsaturated hydrocarbon monomers of C3 and above, such as, polypropylene, polyisobutylene, polymethylbutene-1, polymethylpentene-1, polybutene-1, polyisobutylene, and the like; copolymers derived from two or more monomers, such as, ethylene-propylene copolymers, preferably having at least a majority of propylene, propylene-butene-1 copolymers, propylene-isobutylene copolymers, and the like, and blends thereof, polystyrenes; polyvinylhalides; and engineering thermoplastics, for example, polyamides, polyesters, polyphenyleneoxides, polyphenylenesulfides, polyacetals, aliphatic polyketone co- or terpolymers, poly(ethersulfones), polycarbonates, liquid crystalline polymers, poly(etheretherketones), polyurethanes, and poly (arylates). It is preferred that the thermoplastic resin that is protected by the composition according to the present invention be a polyurethane or a polypropylene.

If the thermoplastic polymer to be stabilized by the composition according to the present invention is a polyurethane, the composition according to the present invention can be added to the polyol that is subsequently reacting with isocyanate to form the polyurethane.

A contribution to solving at least one of the objects according to the invention is also made by the use of the composition according to anyone of its embodiments 1 to 10 as an additive in industrial products, preferably as a part of an additive mixture as defined in embodiments 12 to 14, as an additive in an engine oil as defined in embodiments 15 to 17, or as an additive in a polymer composition as defined in embodiments 18 to 20.

BEST MODE FOR CARRYING OUT THE INVENTION

Additives in the Additive Blend According to the Present Invention

The additive blend (or additive package) according to the present invention is a blend for treatment of industrial and automotive lubricants, which comprises—in addition to the base oil—a combination of different additives such as antioxidants, antiwear additives, dispersants, ashless (metal free) polymeric materials, detergents, antifoam additives, viscosity index improvers, copper passivators, rust inhibitors, pour point depressants, demulsifiers and friction modifiers. The mixture of alkylated diphenylamines of the structural formula (I), (II), (III), and (IV) according to the present invention, preferably the mixture of alkylated diphenylamines of the structural formula (I), (II), (III), and (IV) in which R is a branched residue having the formula —$C_9H_{19}$, may thus by a part of such an additive package.

Suitable antioxidants in the additive blend which can be present in addition to the mixture of alkylated diphenylamines of the structural formula (I); (II), (III), and (IV), preferably in addition to the mixture alkylated diphenylamines of the structural formula (I), (II), (III), and (IV) in which R is a branched residue having the formula —$C_9H_{19}$, are selected from:

1) Alkylated monophenols, for example 2,6-di-tert-butyl-4-methylphenol, 2-butyl-4,6-di-methylphenol, 2,6-di-tert-butyl-4-ethylphenol, 2,6-di-tert-butyl-4-n-butylphenol, 2,6-di-tert-butyl-4-iso-butylphenol, 2,6-di-cyclopentyl-4-methylphenol, 2-(a-methyl-cyclo-hexyl)-4,6-dimethylphenol, 2,6-di-octadecyl-4-methylphenol, 2,4,6-tricyclohexylphenol, 2,6-di-tert-butyl-4-methoxymethylphenol, linear or side chain-branched nonylphenols, for example 2,6-dinonyl-4-methylphenol, 2,4-dimethyl-6-(1'-methyl-undec-1'-yl)phenol, 2,4-dimethyl-6-(1'-methylheptadec-1'-yl)phenol, 2,4-dimethyl-6-(1'-methyltridec-1'-yl)-phenol or mixtures thereof;
2) Alkylthiomethylphenols, for example 2,4-di-octylthiomethyl-6-tert-butylphenol, 2,4-di-octylthiomethyl-6-methylphenol, 2,4-di-octylthiomethyl-6-ethylphenol or 2,6-di-dode-cylthiomethyl-4-nonylphenol;
3) Hydroquinones and alkylated hydroquinones, for example 2,6-di-tert-butyl-4-methoxy-phenol, 2,5-di-tert-butylhydroquinone, 2,5-di-tert-amylhydroquinone, 2,6-diphenyl-4-octadecyloxyphenol, 2,6-di-tert-butylhydroquinone, 2,5-di-tert-butyl-4-hydroxyanisole, 3,5-di-tert-butyl-4-hydroxyanisole, 3,5-di-tert-butyl-4-hydroxyphenyl stearate or bis(3,5-di-tert-butyl-4-hydroxyphenyl)adipate;
4) Tocopherols, for example a-, b-, γ-or δ-tocopherol or mixtures thereof (vitamin E);
5) Hydroxylated thiodiphenyl ethers, for example 2,2'-thiobis(6-tert-butyl-4-methylphe-nol), 2,2'-thiobis(4-octylphenol), 4,4'-thiobis(6-tert-butyl-3-methylphenol), 4,4'-thiobis-(6-tert-butyl-2-methylphenol), 4,4'-thiobis(3, 6-di-sec.-amylphenol) or 4,4'-bis(2,6-dimethyl-4-hydroxyphenyl)disulfide;
6) Alkylidenebisphenols, for example 2,2'-methylenebis (6-tert-butyl-4-methylphenol), 2,2'-methylenebis(6-tert-butyl-4-ethylphenol), 2,2'-methylenebis(4-methyl-6-(a-methyl-cyclohexyl)-phenol), 2,2'-methylenebis(4-methyl-6-cyclohexylphenol), 2,2'-methylene-bis-(6-nonyl-4-methylphenol), 2,2'-methylenebis(4,6-di-tert-butylphenol), 2,2'-ethylidene-bis(4,6-di-tert-butylphenol), 2,2'-ethylidenebis(6-tert-butyl-4-isobutylphenol), 2,2'-methylenebis(6-(a-methylbenzyl)-4-nonylphenol), 2,2'-methylene-bis(6-(a,a-dimethylben-zyl)-4-nonylphenol), 4,4'-methylenebis(2,6-di-tert-butylphenol), 4,4'-methylene-bis(6-tert-butyl-2-methylphenol), 1,1-bis(5-tert-butyl-4-hydroxy-2-methylphenyl)-butane, 2,6-bis(3-tert-butyl-5-methyl-2-hydroxybenzyl)-4-methylphenol, 1,1,3-tris(5-tert-butyl-4-hydroxy-2-methylphenyl)butane, 1,1-bis(5-tert-butyl-4-hydroxy-2-methylphenyl)-3-n-dodecylmercaptobutane, ethylene glycol bis(3,3-bis(3'-tert-butyl-4'-hydroxyphenyl)butyrate), bis(3-tert-butyl-4-hydroxy-5-methylphenyl)dicyclopentadiene, bis(2-(3'-tert-butyl-2'-hydroxy-5'-methylbenzyl)-6-tert-butyl-4-methylphenyl) terephth alate, 1,1-bis(3,5-dimethyl-2-hydroxyphenyl) butane, 2,2-bis(3,5-di-tert-butyl-4-hydroxyphenyl)propane, 2,2-bis(5-tert-butyl-4-hydroxy-2-methylphenyl)-4-n-dodecylmercaptobutane or 1,1,5,5-tetra(5-tert-butyl-4-hydroxy-2-methylphenyl)-pentane;
7) O—, N— and S-benzyl compounds, for example 3,5,3',5'-tetra-tert-butyl-4,4'-dihydroxy-dibenzyl ether, octadecyl 4-hydroxy-3,5-dimethylbenzylmercaptoacetate, tridecyl 4-hydroxy-3,5-di-tert-butylbenzylmercaptoacetate, tris(3,5-di-tert-butyl)amine, bis(4-tert-butyl-3-hydroxy-2,6-dimethylbenzyl)dithioterephthalate, bis(3,5-di-tert-butyl-4-hydroxy-benzyl)sulfide or isooctyl 3,5-di-tert-butyl-4-hydroxy-benzylmercaptoacetate;
8) Hydroxybenzylated malonates, for example dioctadecyl 2,2-bis(3,5-di-tert-butyl-2-hy-droxybenzyl)malonate, dioctadecyl 2-(3-tert-butyl-4-hydroxy-5-methylbenzyl)-malo-nate, d-dodecyl mercaptoethyl-2,2-bis (3,5-di-tert-butyl-4-hydroxybenzyl)-malonate, or di(4-(1,1,3,3-tetramethylbutyl)phenyl)-2,2-bis(3,5-di-tert-butyl-4-hydroxybenzyl)malo nate;
9) Aromatic hydroxybenzyl compounds, for example 1,3,5-tris(3,5-di-tert-butyl-4-hydroxy-benzyl)-2,4,6-trimethylbenzene, 1,4-bis(3,5-di-tert-butyl-4-hydroxybenzyl)-2,3,5,6-tetramethylbenzene or 2,4,6-tris(3,5-di-tert-butyl-4-hydroxybenzyl)phenol;

10) Triazine compounds, for example 2,4-bisoctylmercapto-6-(3,5-di-tert-butyl-4-hydroxyanilino)-1,3,5-triazine, 2-octylmercapto-4,6-bis(3,5-di-tert-butyl-4-hydroxyanilino)-1,3,5-triazine, 2-octylmercapto-4,6-bis(3,5-di-tert-butyl-4-hydroxyphenoxy)-1,3,5-triazine, 2,4,6-tris(3,5-di-tert-butyl-4-hydroxyphenoxy)-1,2,3-triazine, 1,3,5-tris(3,5-di-tert-butyl-4-hydroxybenzyl) isocyanurate, 1,3,5-tris(4-tert-butyl-3-hydroxy-2, 6-dimethylbenzyl)isocyanurate, 2,4,6-tris(3,5-di-tert-butyl-4-hydroxyphenylethyl)-1,3,5-triazine, 1,3,5-tris(3,5-di-tert-butyl-4-hydroxyphenylpropionyl)hexahydro-1,3,5-triazine or 1,3,5-tris-(3,5-dicyclohexyl-4-hydroxybenzyl)-isocyanurate;

11) Benzylphosphonates, for example dimethyl 2,5-di-tert-butyl-4-hydroxybenzyl-phosphonate, diethyl 3,5-di-tert-butyl-4-hydroxybenzylphosphonate, dioctadecyl 3,5-di-tert-butyl-4-hydroxybenzylphosphonate, dioctadecyl 5tert-butyl-4-hydroxy-3-methylbenzylphosphonate, or the calcium salt of the monoethyl ester of 3,5-di-tert-butyl-4-hydroxybenzylphosphonic acid;

12) Acylaminophenols, for example 4-hydroxylauranilide, 4-hydroxystearanilide, or octyl N-(3, 5-di-tert-butyl-4-hydroxyphenyl) carbamate;

13) Esters of b-(3, 5-di-tert-butyl-4-hydroxyphenyl) propionic acid, b-(5-tert-butyl)-4-hydroxy-3-methylphenyl) propionic acid, b-(3, 5-dicyclohexyl-4-hydroxyphenyl)-propionic acid, 3,5-di-tert-butyl-4-hydroxyphenylacetic acid, or b-(5-tert-butyl)-4-hydroxypheny))-3-thiabutyric acid with mono- or polyhydric alcohols, e. g. with methanol, ethanol, n-octanol, i-octanol, octadecanol, 1,6-hexanediol, 1,9-nonanediol, ethylene glycol, 1,2-propanediol, neopentyl glycol, thiodiethylene glycol, diethylene glycol, triethylene glycol, pentaerythritol, tris(hydroxyethyl) isocyanurate, N,N'-bis(hydroxyethyl) oxalamide, 3-thiaundecanol, 3-thiapentadecanol, trimethyl-hexanediol, trimethylolpropane, 4-hydroxymethyl-1-phospha-2,6,7-trioxabicyclo(2.2.2)octane, glycerol, or transesterification products based on natural triglycerides of, for example, coconut oil, rape seed oil, sunflower oil, or colza oil;

14) Amides of b-(3, 5-di-tert-butyl-4-hydroxyphenyl)propionic acid, e. g. N,N'-bis(3,5-di-tert-butyl-4-hydroxyphenylpropionyl) hexamethylenediamine, N,N'-bis(3,5-di-tert-butyl-4-hydroxyphenylpropionyl) trimethylenediamine, or N,N'-bis(3,5-di-tert-butyl-4-hydroxyphenylpropionyl)hydrazine;

15) Ascorbic acid (vitamin C);

16) Amine-type antioxidants, for example N,N'-diisopropyl-p-phenylenediamine, N,N'-di-sec-butyl-p-phenylenediamine, N,N'-bis(1,4-dimethylpentyl)-p-phenylenediamine, N,N'-bis(1-ethyl-3-methyl-pentyl)-p-phenylenediamine, N,N'-bis(1-methyl-heptyl)-p-phenylenediamine, N,N'-dicyclohexyl-p-phenylenediamine, N,N'-diphenyl-p-phenylenediamine, N,N'-di-(naphth-2-yl)-p-phenylenediamine, N-isopropyl-N'-phenyl-p-phenylene-diamine, N-(1,3-dimethylbutyl)-N'-phenyl-p-phenylenediamine, N-(1-methylheptyl)-N'-phenyl-p-phenylenediamine, N-cyclohexyl-N'-phenyl-p-phenylenediamine, 4-(p-toluenesulfonamido) diphenylamine, N,N'-dimethyl-N,N'-di-sec-butyl-p-phenylenediamine, diphenylamine, N-allyldiphenylamine, 4-isopropoxy-diphenylamine, N-phenyl-1-naphthylamine, N-(4-tert-octylphenyl)-1-naphthylamine, N-phenyl-2-naphthylamine, octylated diphenylamine, e. g. p,p'-di-tert-octyldiphenylamine, 4-n-butylaminophenol, 4-butyrylaminophenol, 4-nonanoylaminophenol, 4-dodecanoylaminophenol, 4-octadecanoylaminophenol, di-(4-methoxyphenyl)-amine, 2,6-di-tert-butyl-4-dimethylamino-me-thylphenol, 2,4'-diamino-diphenylmethane, 4,4'-diamino-diphenylmethane, N,N,N',N'-tetramethyl-4,4'-diamino-diphenylmethane, 1,2-di-((2-methyl-phenyl)-amino)ethane, 1,2-di-(phenylamino)propane, (o-tolyl)biguanide, di(4-(1',3'-dimethyl-butyl)-phenyl)amine, tert-octylated N-phenyl-1-naphthylamine, a mixture of mono- and dialkylated tert-butyl/tert-octyldiphenylamines, a mixture of mono- and dialkylated nonyldiphenylamines, a mixture of mono- and dialkylated dodecyldiphenylamines, a mixture of mono- and dialkylated isopropyl/isohexyldiphenylamines, mixtures of mono- and dialkylated tert-butyldiphenylamines, 2,3-dihydro-3,3-dimethyl-4H-1,4-benzothiazine, phenothiazine, a mixture of mono- and dialkylated tert-butyl/tert-octylphenothiazines, a mixture of mono- and dialkylated tert-butyl/tert-octyl-phenothiazines, N-allylphenothiazine, N,N,N',N''-tetraphenyl-1,4-diaminobut-2-ene, N,N-bis(2,2,6,6-tetramethylpiperidin-4-yl)hexamethylenediamine, bis-(2,2,6,6-tetramethylpiperidin-4-yl) sebacate, 2,2,6,6-tetramethylpiperidin-4-one, or 2,2,6,6-tetramethylpiperidin-4-ol; and 17) Aliphatic or aromatic phosphites, esters of thiodipropionic acid, or of thiodiacetic acid, or salts of dithiocarbamic or dithiophosphoric acid, 2,2,12,12-tetramethyl-5,9-dihydroxy-3,7,1-trithiatridecane, or 2,2,15,15-tetramethyl-5,12-dihydroxy-3,7,10,14-tetrathiahexadecane.

Suitable antiwear additives are selected from:

1) Dihydrocarbyl dithiophosphate metal salts where the metal is aluminum, lead, tin manganese, cobalt, nickel, zinc or copper, but most often zinc. The zinc salt (zinc dialkyl dithiophosphate) is represented as

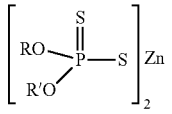

where R and R' are independently represent $C_1$-$C_{20}$ alkyl, $C_3$-$C_{20}$ alkenyl, $C_5$-$C_{12}$ cycloalkyl, $C_7$-$C_{13}$ aralkyl or $C_6$-$C_{10}$ aryl, for example R and R' are independently, $C_1$-$C_{12}$ alkyl; and 2) Sulfur-and/or phosphorus-and/or halogen-containing compounds, such as sulfurized olefins and vegetable oils, tritolyl phosphate, tricresyl phosphate, chlorinated paraffins, alkyl and aryl di-and trisulfides, amine salts of mono- and dialkyl phosphates, amine salts of methylphosphonic acid, diethanolaminomethyltolyltriazole, di(2-ethylhexyl)aminomethyltolyltriazole, derivatives of 2, 5-dimercapto-1,3, 4-thiadiazole, ethyl((bisisopropyloxyphosphinothioyl)thio) propionate, triphenyl thiophosphate(triphenyl phosphorothioate), tris(alkylphenyl)phosphorothioates and mixtures thereof (for example tris(isononylphenyl)phosphorothioate), diphenyl-mononylphenylphosphorothioate, isobutylphenyldiphenylphosphorothioate, the dodecylamine salt of 3-hydroxy-1,3-thiaphosphetan-3-oxide, trithiophosphoric acid 5,5,5-tris(isooctyl 2-acetate), derivatives of 2-mercaptobenzothiazole, such as 1-(N,N-bis(2-ethylhexyl) aminomethyl)-2-mercapto-1H-1, 3-benzothiazole, or ethoxycarbonyl 5-octyldithiocarbamate.

Suitable dispersants are selected from:

1) Mannich bases that are condensation reaction products of a high molecular weight phenol, an allylene polyamine, and an aldehyde, such as formaldehyde;
2) Succinic-based dispersants that are reaction products of a olefin polymer, and succinic acylating agent (acid, anhydride, ester or halide), further reacted with an organic hydroxy compound and/or an amine; and
3) High molecular weight amides and esters, such as reaction products of a hydrocarbyl acylating agent and a polyhydric aliphatic alcohol (such as glycerol, pentaerythritol or sorbitol).

Ashless (metal-free) polymeric materials that usually contain an oil soluble high molecular weight backbone linked to a polar functional group that associates with particles to be dispersed are typically used as dispersants. Commonly used hydrocarbon backbone materials are olefin polymers and copolymers, i.e.-ethylene, propylene, butylene, isobutylene, styrene; there may or may not be further functional groups incorporated into the backbone of the polymer. Polar materials, such as amines, alcohols, amides or esters are attached to the backbone via a bridge.

Suitable detergents are selected from: calcium, magnesium, barium, sodium or lithium salts of organic acids, for example, sulphonates, alkylphenates, sulfurized alkyl phenates, carboxylates, salicylates, phosphonates, thiophosphonates, and phosphinates. The salts may be neutral or may be overbased by, for example, metal hydroxides or carbonates.

Suitable antifoam additives are selected from: silicone oils, polysiloxanes, and polyethylene glycol ethers.

Suitable viscosity index improvers are selected from: polyisobutylene, co- polymers of ethylene and propylene, polyacrylates, polymethacrylates, vinylpyrrolidone/methacrylate copolymers, polyvinylpyrrolidones, polybutenes, olefin copolymers, styrene/ acrylate copolymers, styrene/isoprene copolymers, styrene/isobutadiene copolymers, isoprene/butadiene copolymers and polyethers.

Suitable copper passivators are selected from:

1) Benzotriazoles and their derivatives, for example 4-or 5-alkylbenzotriazoles (e. g. tolutriazole) and derivatives thereof, 4,5,6,7-tetrahydrobenzotriazole, 5,5'-methylenebisbenzotriazole; Mannich bases of benzotriazole or tolutriazole, such as 1-(di(2-ethylhexyl) aminomethyl)tolutriazole and 1-(di-(2-ethylhexyl) aminomethyl)-benzotriazole;
   alkoxyalkylbenzotriazoles, such as 1-(nonyloxymethyl)-benzotriazole, 1-(1-butoxyethyl)-benzotriazole, or 1-(1-cyclohexyloxybutyl)-tolutriazole;
2) Imidazole derivatives, for example 4,4'-methylenebis (2-undecyl-5-methyl-imidazole), bis((N-methyl)imidazol-2-yl)carbinol octyl ether;
3) Sulfur-containing heterocyclic compounds, for example, 2-mercaptobenzothiazole, 2,5-dimercapto-1, 3,4-thiadiazole, 2,5-dimercaptobenzothiadiazole and derivatives thereof, or 3,5-bis(di(2-ethylhexyl) aminomethyl)-1,3,4-thiadiazolin-2-one; and
4) Amino compounds, for example, salicylidenepropylenediamine, salicylaminoguanidine or salts thereof.

Suitable rust inhibitors are selected from:

1) Nonionic polyoxyalkylene polyols and their esters, polyoxyalkylene phenols, organic acids, their esters, metal salts, amine salts and anhydrides, for example alkyl- and alkenylsuccinic acids and the partial esters thereof with alcohols, diols or hydroxycarboxylic acids, partial amides of alkyl-and alkenyisuccinic acids, 4-nonylphenoxyacetic acid, alkoxy- and alkoxyethoxycarboxylic acids, such as dodecyloxyacetic acid, dodecyloxy(ethoxy) acetic acid and the amine salts thereof, or N-oleoylsarcosine, sorbitan monooleate, lead naphthenate and alkenylsuccinic anhydrides, for example dodecenylsuccinic anhydride, 2-(2-carboxyethyl)-1-dodecyl-3-methylglycerol and its salts, for example, sodium and triethanolamine salts;
2) Nitrogen-containing compounds selected from: i) Primary, secondary, or tertiary aliphatic or cycloaliphatic amines and amine salts of organic and inorganic acids, for example oil-soluble alkylammonium carboxylates, and also 1-(N,N-bis(2-hydroxyethyl) amino)-3-(4-nonylphenoxy)propan-2-ol, or ii) Heterocyclic compounds, for example: substituted imidazolines or oxazolines, for example, 2-heptadecenyl-1-(2-hydroxyethyl)-imidazoline;
3) Phosphorus-containing compounds, for example amine salts of phosphoric acid, phosphoric acid partial esters or phosphonic acid partial esters, or zinc dialkyldithiophosphates;
4) Sulfur-containing compounds, for example barium dinonylnaphthalene-sulfonates, calcium petroleum-sulfonates, alkylthio-substituted aliphatic carboxylic acids, esters of aliphatic 2-sulfocarboxylic acids, or salts thereof; and
5) Glycerol derivatives, for example glycerol monooleate, 1-(alkylphenoxy)-3-(2-hydroxyethyl)glycerols, 1-(alkylphenoxy)-3-(2,3-dihydroxypropyl)glycerols, or 2-carboxyalkyl-1,3-dialkylglycerols.

Suitable pour point depressants are selected from polymethacrylates and alkylated naphthalene derivatives.

Suitable demulsifiers are selected from polyetherpolyols and dinonyinaphthalenesulfonates.

Suitable friction modifiers are selected from fatty acids and their derivatives, e. g. natural esters of fatty acids, such as glycerol monooleate, amides, imides and amines, e. g. oleylamine, sulfur containing organomolybdenum dithiocarbamates, sulfurphosphorus containing organomolybdenum dithiophosphates, sulfur-nitrogen containing or—ganomolybdenum compounds based on dispersants, molybdenum carboxylate salts, molybdenum-amine complexes, molybdenum amine/alcohol/amid complexes, and molybdenum cluster compounds, Teflon® and molybdenum disulfide.

Base Oils in the Engine Oil According to the Present Invention

The engine oil according to the present invention comprises at least one base oil (i. e. a lubricant of lubricating viscosity) and the mixture of alkylated diphenylamines of the structural formula (I), (II), (III), and (IV) according to the present invention, preferably the mixture of alkylated diphenylamines of the structural formula (I), (II), (III), and (IV) in which R is a branched residue having the formula —$C_9H_{19}$, preferably the additive blend defined in embodiments 12 to 14.

Suitable base oils are mineral and synthetic base oils chosen from Group I to V. These base oils are broadly specified in the American Petroleum Institute (API) Base Oil Interchangeability Guidelines.

The base oils can be oils and greases, for example, based on mineral oil or vegetable and animal oils, fats, tallow and wax or mixtures thereof. Vegetable and animal oils, fats, tallow and wax are, for example, palm kernel oil, palm oil, olive oil, colza oil, rapeseed oil, linseed oil, soy bean oil, cotton wool oil, sunflower oil, coconut oil, maize oil, castor oil, walnut oil, and mixtures thereof, fish oils, and chemically modified, e.g. epoxidized or sulphoxidezed, forms or forms prepared by genetic engineering, for example soy bean oil prepared by genetic engineering.

Examples of synthetic base oils include lubricants based on aliphatic or aromatic carboxylic esters, polymeric esters, polyalkylene oxides, phosphoric acid esters, poly-a-olefins, silicones, alkylated benzene, alkylated naphthalenes or the diester of a di basic acid with a monohydric alcohol, e.g. dioctyl sebacate or dinonyl adipate, of a triester of trimethylolpropane with a monobasic acid or with a mixture of such acids, e.g. trimethylolpropane tripelargonate, trimethylolpropane tricaprylate, or mixtures thereof, of a tetra ester of pentaerythritol with a monobasic acid or with a mixture of such acids, e.g. pentaerythrityl tetracaprylate, or of a complex ester of monobasic and dibasic acids with polyhydric alcohols, e.g. a complex ester of trimethylolpropane with caprylic and sebacic acid or of a mixture thereof. Particularly suitable in addition to mineral oils are, for example, poly-a-olefins, ester-based lubricants, phosphates, glycols, polyglycols, and polyalkylene glycols, and mixtures thereof with water.

When in addition to the mixture of alkylated diphenylamines of the structural formula (I), (II), (III), and (IV) according to the present invention, preferably in addition to the mixture of alkylated diphenylamines of the structural formula (I), (II), (III), and (IV) in which R is a branched residue having the formula —$C_9H_{19}$, other additives are employed, it may be desirable, although not necessary, to prepare additive concentrates in the form of the above described additive blend (or additive package) comprising concentrated solutions or dispersions of the mixture of alkylated diphenylamines of the structural formula (I), (II), (III), and (IV) according to the present invention together with one or more of said other additives, whereby several additives can be added simultaneously to the base oil to form a lubricating oil composition. Dissolution of the additive concentrate into the lubricating oil can be facilitated by solvents and by mixing accompanied by mild heating, but this action is not essential. The concentrate or additive blend will typically be formulated to contain the additives in proper amounts to provide the desired concentration in the final formulation when the additive blend is combined with a predetermined amount of the base oil. Thus, the mixture of alkylated diphenylamines of the structural formula (I), (II), (III), and (IV) according to the present invention can be added to small amounts of base oil or other compatible solvents along with other desirable additives to form an additive blend containing active ingredients in collective amounts of, typically, from about 2.5 to about 90 wt. %, preferably from about 15 to about 75 wt. %, and more preferably from about 25 percent to about 60 wt. % additives in the appropriate proportions with the remainder being base oil. The final formulations can typically employ about 1 to 20 wt. % of the additive blend the remainder being base oil.

Thermoplastic Polymers in the Polymer Composition According to the Present Invention The polymer composition according to the present invention comprises, in addition to the mixture of alkylated diphenylamines of the structural formula (I), (II), (III), and (IV) according to the present invention, preferably in addition to the mixture of alkylated diphenylamines of the structural formula (I), (II), (III), and (IV) in which R is a branched residue having the formula —$C_9H_{19}$, a polymer, preferably a thermoplastic polymer.

The thermoplastic polymers that can be stabilized against oxidative degradation employing the mixture of alkylated diphenylamines of the structural formula (I), (II), (III), and (IV) include resins derived from ethylene including low density polyethylene (LDPE), linear low density polyethylene (LLDPE), medium density polyethylene (MDPE), high density polyethylene (HDPE), or other ethylene derived resins that have densities from 0.85 to 1.4 gm/cm$^3$; homopolymers derived from mono- and diethylenically unsaturated hydrocarbon monomers of C3 and above, such as, polypropylene, polyisobutylene, polymethylbutene-1, polymethylpentene-1, polybutene-1, polyisobutylene, and the like; copolymers derived from two or more monomers, such as, ethylene-propylene copolymers, preferably having at least a majority of propylene, propylene-butene-1 copolymers, propylene-isobutylene copolymers, and the like, and blends thereof, polystyrenes; polyvinylhalides; and engineering thermoplastics, for example, polyamides, polyesters, polyphenyleneoxides, polyphenylenesulfides, polyacetals, aliphatic polyketone co- or terpolymers, poly(ethersulfones), polycarbonates, liquid crystalline polymers, poly(etheretherketones), polyurethanes and poly(arylates). It is preferred that the thermoplastic resin that is protected by the composition according to the present invention be a polyurethane or a polypropylene.

The invention is now described in more detail by reference to test methods and non-limiting examples.

MODE FOR THE INVENTION

Test Methods

Determination of Oxidative Stability

The oxidative stability was evaluated by means of a pressurized differential scanning calorimetry (PDSC) apparatus.

The PDSC examines an oil's oxidative stability under thin-film oxidation conditions. In the isothermal mode where PDSC temperature is maintained at a predetermined value, a test oil's oxidation stability is ranked according to the oxidation induction time (OIT), corresponding to an exothermic release of heat caused by the onset of oxidation of the oil. Oil giving longer OIT is generally considered more resistant to oxidation. Each blend was tested in duplicate using the following instrumental conditions and the average OIT was determined. The PDSC test temperature was 185° C.

The following measuring conditions have been selected:

Temperature ramp: 40° C./min

Pressures: 500 psi 0 2 flow: 100 ml/min

Sample size: ~1.5 mg

Pan: Aluminum, open

Determination of Lead Corrosion

The corrosion of lead was determined according to ASTM D 6594.

EXAMPLE

A commercially available mixture of alkylated diphenylamines of the structural formula (I), (II), (III) in which R represents a branched alkyl group having the formula —$C_9H_{19}$ was supplemented with different amounts of the corresponding alkylated diphenylamine of the structural formula (IV), subsequently referred to as "TN-DPA" (tetranonyl diphenylamine). Samples in Table 1 have been obtained and analyzed:

TABLE 1

| Sample | nonyl-DPA [wt. %] | di-nonyl-DPA [wt. %] | Tri-nonyl-DPA [wt. %] | TN-DPA [wt. %] |
|---|---|---|---|---|
| 1 | 20.4-24.9 | 64.4-78.8 | 5.0-6.1 | 0.19 |
| 2 | 21.0-25.7 | 65.0-79.5 | 3.7-4.5 | 0.32 |
| 3 | 21.0-25.7 | 65.0-79.4 | 3.7-4.4 | 0.42 |
| 4 | 20.0-24.5 | 64.9-79.4 | 3.6-4.4 | 0.60 |
| 5 | 20.5-25.1 | 63.8-78.0 | 3.8-4.6 | 2.13 |
| 6 | 20.3-24.9 | 63.0-77.0 | 3.8-4.7 | 3.12 |
| 7 | 20.0-24.4 | 61.5-75.2 | 5.0-6.1 | 5.16 |

Using the above described samples of a mixture comprising mono-, di, tri- and tetranonyl diphenylamine a fully finished engine oil was prepared. For that purpose, the sample was added separately to an antioxidant-free fully finished engine oil in an amount of 1.0 wt. %. The engine oil was formulated with API Group III base oils which consisted of a mixture of Yubase 4 and Yubase 6 obtained from SK Lubricants Co. Ltd., Seoul, Korea. From the thus obtained lubricants the oxidative stability and the lead corrosion have been determined (by means of the PDSC- and the ASTM D 6594-test). The results of the PDSC-test are shown in Table 2, and the results of the ASTM D 6594-test are shown in Table 3:

TABLE 2

| Sample | TN-DPA [wt. %] | oxidative stability[1)] determined by PDSC [min] |
|---|---|---|
| 1 | 0.19 | 19.68 |
| 2 | 0.32 | 20.18 |
| 3 | 0.42 | 20.43 |
| 4 | 0.60 | 20.45 |
| 5 | 2.13 | 20.38 |
| 6 | 3.12 | 20.40 |
| 7 | 5.16 | 19.95 |

[1)]average value of two measurements

TABLE 3

| Sample | TN-DPA [wt. %] | lead corrosion[1)] determined according to ASTM D 6594 [DPb in ppm]] |
|---|---|---|
| 1 | 0.19 | 17 |
| 4 | 0.60 | 4 |
| 5 | 2.13 | 4 |

TABLE 3-continued

| Sample | TN-DPA [wt. %] | lead corrosion[1)] determined according to ASTM D 6594 [DPb in ppm]] |
|---|---|---|
| 6 | 3.12 | 3 |
| 7 | 5.16 | 8 |

[1)]average value of two measurements

As can be seen from the results shown in tables 2 and 3, adjusting the content of tetra-alkylated diphenylamines of the structural formula (IV) in a composition comprising alkylated diphenylamines of the structural formulas (I), (II), (III), and (IV) to the very narrow range of 0.2 to 3.5 wt. % leads to compositions which, when added to a base oil for the formation of an engine oil, provide an optimum performance of the engine oil with respect to both, the oxidative stability and the resistance towards the corrosion of lead.

The invention claimed is:

1. A composition comprising alkylated diphenylyamines of the structural formulas (I), (II), (III), and (IV):

(I)

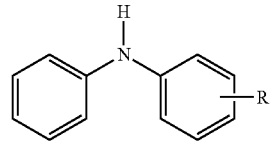

(II)

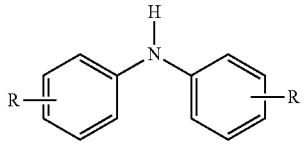

(III)

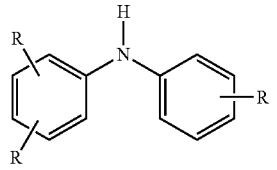

(IV)

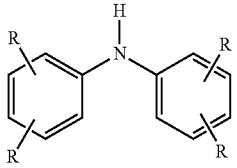

wherein R is a branched alkyl group having the formula —$C_9H_{19}$, and wherein the total amount of tetra-nonyl diphenylamines is in the range from 0.20 to 3.5 wt.-%, based on the total weight of alkylated diphenylamines of the structural formula (I), (II), (III), and (IV) in the composition.

2. The composition according to claim 1, wherein the total amount of monoalkylated diphenylamines of the structural formula (I) is in the range from 10 to 35 wt.-%, based on the total weight of alkylated diphenylamines of the structural formula (I), (II), (III), and (IV) in the composition.

3. The composition according to claim 1, wherein the total amount of dialkylated diphenylamines of the structural formula (II) is in the range from 60 to 85 wt.-%, based on the total weight of alkylated diphenylamines of the structural formula (I), (II), (III), and (IV) in the composition.

4. The composition according to claim 1, wherein the total amount of trialkylated diphenylamines of the structural formula (III) is in the range from 1 to 10 wt.-%, based on the total weight of alkylated diphenylamines of the structural formula (I), (II), (III), and (IV) in the composition.

5. The composition according to claim 1, wherein the composition further comprises less than 1 wt.-% of non-alkylated diphenylamine, based on the total weight of alkylated diphenylamines of the structural formula (I), (II), (III), and (IV) in the composition.

6. The composition according to claim 1, wherein at least one of the following conditions (α1) to (α6) is fulfilled:

(α1) the composition has a kinematic viscosity (determined at a temperature of 40° C. according to ASTM D 445) in the range from 100 to 1000 cSt;

(α2) the composition has a Gardner colour (determined according to ASTM D 1544) of less than 15 Gardner;

(α3) the composition has water content (determined according to ASTM E 203) of less than 0.1 wt.-%;

(α4) the composition has a nitrogen content (determined according to ASTM D 2896) in the range from 3.2 to 3.8%;

(α5) the composition has a specific gravity (determined at a temperature of 25° C. according to ASTM D 1298) in the range from 0.930 to 0.980;

(α6) the composition has a total base number (TBN) (determined according to ASTM D 2896) in the range of 125 to 160 mg KOH/g.

7. The composition according to claim 1, wherein the total amount of alkylated diphenylamines of the structural formula (I), (II), (III), and (IV) is at least 98 wt.-%, based on the total weight of the composition.

8. The composition according to claim 1, wherein the composition is an additive blend.

9. The composition according to claim 8, wherein the total amount of alkylated diphenylamines of the structural formula (I), (II), (III), and (IV) is in the range from 0.01 to 30 wt.-%, based on the total weight of the additive blend.

10. The composition according to claim 1, wherein the composition is an engine oil comprising at least one base oil.

11. The composition according to claim 10, wherein the total amount of alkylated diphenylamines of the structural formula (I), (II), (III), and (IV) is in the range from 0.01 to 5 wt.-%, based on the total weight of the engine oil.

12. The composition according to claim 1, wherein the composition is a polymer composition comprising a polymer.

13. The composition according to claim 12, wherein the total amount of alkylated diphenylamines of the structural formula (I), (II), (III), and (IV) is in the range from 0.01 to 1 wt.-%, based on the total weight of the polymer composition.

14. Use of the composition according to claim 1 as an additive in additive blends, engine oils, or polymer compositions.

* * * * *